US005279530A

United States Patent [19]

Hess

[11] Patent Number: 5,279,530

[45] Date of Patent: Jan. 18, 1994

[54] PORTABLE LEG EXERCISING APPARATUS

[76] Inventor: Daniel F. Hess, 3148 Hyde Park Dr., Lexington, Ky. 40503

[21] Appl. No.: 877,413

[22] Filed: May 1, 1992

[51] Int. Cl.[5] ..... A63B 22/00

[52] U.S. Cl. ..... 482/70; 482/79; 482/121

[58] Field of Search ..... 482/60, 70, 71, 51, 482/52, 79, 23, 140, 121; 128/25

[56] References Cited

U.S. PATENT DOCUMENTS

| | | | |
|---|---|---|---|
| D. 211,478 | 6/1968 | Margolies . | |
| 2,720,396 | 10/1955 | Pfaus | 482/79 |
| 3,058,742 | 10/1962 | Jaffe | 482/60 |
| 3,430,956 | 3/1969 | Borgeas | 482/79 |
| 4,487,413 | 12/1984 | Fall | 482/23 |
| 4,496,147 | 1/1985 | DeCloux et al. . | |
| 4,905,990 | 3/1990 | DeSantis | 482/23 |
| 5,125,650 | 6/1992 | Paris | 482/140 |

FOREIGN PATENT DOCUMENTS

| | | | |
|---|---|---|---|
| 3631622 | 3/1987 | Fed. Rep. of Germany | 482/142 |
| 2172211 | 3/1985 | United Kingdom | 482/142 |

OTHER PUBLICATIONS

Bed Exerciser, Flaghouse Rehab Catalog Excerpt, Winter 1991.

CMC Shuttle 2000 Plyometric Power Training Brochure.

Exercise Catalog PC1945.

*Primary Examiner*—Richard J. Apley
*Assistant Examiner*—Jerome Donnelly
*Attorney, Agent, or Firm*—King & Schickli

[57] ABSTRACT

A portable leg exercising apparatus especially adapted for lower back rehabilitation is provided, having an adjustable, V-shaped frame assembly constructed from lightweight tubular material, and oriented so that a base forming one side of the V lies adjacent to the floor. The other side of the V extends upwardly from the vertex at an incline forming spaced guide rails. Adjustable support braces extend between the two sides of the V-shaped frame opposite the vertex. The support braces and cross tube are adjustable to accommodate various angles of inclination of the guide rails. In the extreme lowered position, the frame assembly is substantially flattened to facilitate portability and storage. Independently movable carriages having foot pedals slide along the rails in response to the force applied by the legs of the user. Elastic cords extending between the frame and the carriages serve to provide elastic resistance to the leg motion as the carriages move upwardly along the inclined rails. The foot pedals may be lowered to enhance the portability/storage capability.

19 Claims, 2 Drawing Sheets

PORTABLE LEG EXERCISING APPARATUS

TECHNICAL FIELD

The present invention relates generally to leg exercising equipment and, more particularly, to a portable leg exercising apparatus providing effective rehabilitation for lower extremity and lower back problems.

BACKGROUND OF THE INVENTION

The importance of therapeutic exercise of the human body is widely accepted for a variety of innate human disabilities, as well as for muscle building, general fitness and/or weight control. Exercise also plays a critical role in the rehabilitation of patients suffering from various injuries. Indeed, physical therapists provide professional counseling for patients to individually tailor particular exercise programs to meet a patient's specific needs. Rehabilitating exercises differ depending upon the type of disability or trauma present, as well as the type of tissue targeted in the exercise. For example, rehabilitation of muscle tissue demands a different type of exercise than does the rehabilitation of tendons, ligaments, or cartilage tissues.

More specifically, oxygen plays a crucial role in the strengthening and healing process of tissue. The number of repetitions in a given exercise necessarily dictates the amount of oxygen that is supplied to a particular tissue area. It has been determined that tissues found in the lower spine area, such as ligaments, tendons and cartilage, demand a greater supply of oxygen for strengthening and healing, than does muscle tissue. Therefore, higher repetition exercises are recommended for the rehabilitation of these tissues. To facilitate the increase in repetitions, the weight or resistance opposing the exercise must be decreased.

For leg exercises, exercise bicycles and stair climbing apparatus offer low resistance movements to facilitate such aerobic or high repetition exercises. However, these devices are not viable options for all persons having lower back problems. Often persons with acute or chronic lower back problems require exercises that, as near as possible, immobilize, or at least reduce, the stress on their lower back. It can be appreciated that the movements required for both cycling and stair climbing provide excessive stress on the lower back area, and thus are often unsuitable for such patients.

Fitness centers provide various types of equipment that can isolate the leg muscles primarily for muscle building without stressing the lower back area. For example, leg press machines are commonly available in fitness centers, whereby a user utilizes an extension or pressing action of his legs to move a weighted platform, or pedals with built-in resistance, through a particular range of motion. These leg press machines have various adaptations: i.e. some machines allow the user to sit upright and exert a horizontal pressing motion; some allow the user to lie flat on the back and press the weight platform upward in a vertical direction; and still others allow the user to sit in a reclined position pressing the platform along an inclined ramp. The user can appropriately select a light weight for these exercises, thereby facilitating high repetitions; however, the primary focus remains on the muscles.

There are various other problems with using fitness center equipment for rehabilitation exercises. First, the centers are frequently inaccessible. Many people simply prefer exercising in private at home, and others find the high cost of fitness center memberships prohibitive. Further, many rehabilitation patients are physically unable to travel to the facilities to use their equipment. Also, although the type of exercising equipment normally found in fitness centers can be purchased, it is unsuitable for personal use at home. In addition to the normally high cost of such equipment, it is often too heavy and/or bulky to satisfy the portability needs of a home user.

In addition to the types of equipment described above, there are various other exercise machines more specifically tailored for use by the physical therapy or rehabilitation patient. For example, exercising devices exist that are designed for patients confined to bed. These generally employ a frame that attaches to the bed with pedals positioned above the patient's body to allow exercise of the legs. The pedals are oriented so as to limit the leg movement to a generally horizontal plane. While this and other specialized machines effectively meet particular patient needs, they have been found not to be ideally suitable for rehabilitation of disabilities, and thus relief of pain, of the lower back. These machines also generally suffer the shortcomings of high cost, limited portability, and limited versatility.

An additional shortcoming present in many prior art leg exercising apparatus of which I am aware relates to independent leg movement. For example, exercise bicycles require both legs to be used equally. Likewise, most of the leg press machines require uniform motion of both legs. It can be appreciated that many patients have disabilities, such as a particular injury of the lower back, that is best rehabilitated by exercise of one leg at a time. Also, I have discovered that movement up a gradual incline with elastic resistance of the leg movement provides a decided advantage for lower back pain relief over other machines built for general exercise and muscle building use. It is also desirable to have the ability to independently vary the amount of resistance and range of motion for each leg.

Accordingly, there is a significant need for a lightweight, portable leg exercising apparatus that provides an improved and more effective exercise device for treatment for lower back disability and is a viable option for in-home physical therapy. The device should be adaptive for patients confined to bed, and yet versatile enough for use on the open floor. It should also provide for independent and variable resistance adjustment for each leg to accommodate specific patient needs.

SUMMARY OF THE INVENTION

It is accordingly a primary object of the present invention to provide a portable leg exercising apparatus especially useful for treatment of lower extremity and back disabilities and convenient in-home use.

Another object of the present invention is to provide a portable leg exercising apparatus having substantial cost savings over existing leg exercise equipment.

Still another object of the present invention is to provide a portable leg exerciser providing for leg movement with minimal stress on the lower back.

Yet another object of the present invention is to provide a portable leg exercising apparatus having ideal inclination, elastic resistance and range of movement for each leg to provide the physical therapist and the patient with maximum versatility for establishing the ideal exercise program.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved leg exercising apparatus is provided. The apparatus is advantageously designed for use in a reclined position to provide the most efficient and comfortable lower extremity and back rehabilitation for the user. Furthermore, the apparatus is collapsible into a space-saving configuration to facilitate portability and storage when not in use.

The leg exercising apparatus comprises a frame assembly including a base and guide rails that extend upwardly at an incline. Spaced carriage assemblies are disposed for engagement by the feet of the user when in a reclined position. Each carriage assembly is designed for independent travel along the guide rails when pressure is applied. Each carriage assembly has attached to it elastic resistance means to oppose the force generated by the legs of the user. Accordingly, when the user pushes on the carriage assembly during operation, it moves along the inclined guide rail against the elastic resistance, offering substantially ideal exercise for the lower back area.

In the preferred embodiment, the frame assembly is constructed from lightweight, plastic tubular material. The structural composition of the frame assembly thus facilitates set-up and ease of portability.

The base is comprised of tubes that connect together to substantially form a rectangle that extends in a horizontal plane. The guide rails are each formed as a pair of spaced tubes; each pair supporting a carriage assembly therebetween. The elevated, inclined guide rails are connected to the base adjacent the horizontal surface on which the frame assembly lies while in use. Thus, the guide rails and the base meet at a vertex position adjacent the location of the user when exercising. Thus, it can be visualized that the frame assembly is substantially V-shaped.

The leg exercising apparatus further includes a pair of spaced support braces connecting the guide rails to the base of the frame assembly. The support braces provide the appropriate incline to form the "V" configuration.

Advantageously, the positioning of each support brace is adjustable to vary the angle of inclination of the guide rails. An adjustable collar pivotally mounts the bottom of each support brace to the base. Each of the collars is slidable along the respective longitudinal tube of the base to selectively position the brace and vary the angle of the incline. The collars are slidable to an extent to create a range of adjustment that allows the leg exercising apparatus to collapse into a substantially flat configuration for portability and storage.

In an important aspect of the invention, each carriage assembly has a pedal assembly to allow pressure to be applied independently by each of the user's feet. Each pedal assembly is disposed in a relatively upright position when in operation to present sufficient surface area for engagement by the foot. In addition, the pedal assembly may be lowered to a collapsed position to facilitate portability and storage of the exercising apparatus when it is not in use. It can be appreciated that the lowering of the guide rails onto the base of the frame assembly in conjunction with the lowering of the pedal assemblies brings the leg exercising apparatus into a substantially planar configuration, thus minimizing the space it occupies during storage.

Each carriage assembly includes a pair of slide collars that are mounted on each pair of guide tubes forming the guide rail. Each pair of slide collars carries the foot pedal assembly that reciprocates along the guide tubes during use.

The slide collars are preferably split into fore and aft carriage sections that include fore and aft carriage plates. Each foot pedal assembly includes a pedal that is pivotally mounted to the aft carriage plate. The pedal is provided with an angled support that engages the cooperating fore carriage plate to position the pedal in an upright position for use. Adjustable stop collars are provided on at least one of each pair of guide tubes. The collars serve to independently limit the extent of longitudinal travel of the slide collars along the guide tubes. Thus, the adjustment of the stop collars controls the extent of leg movement by the user.

The elastic resistance of the leg exercising apparatus is provided by elastic cords attached between the frame assembly and each carriage assembly. The elastic cords are independently attached to each carriage assembly to facilitate separate operation and permit independent resistance to the movement of each carriage assembly. Advantageously, the elastic cords are independently adjustable so as to allow the resistance applied to each carriage assembly to vary according to the user's individual needs.

The elastic cords are connected to the fore carriage plate. Preferably, the fore carriage plate has a plurality of notches, each notch receiving a separate elastic cord. Each cord is formed with a plurality of enlarged knots to facilitate the selective positioning of the cord within the notch. Accordingly, by selecting the desired knot to engage the corresponding notch in the fore carriage plate, the elastic resistance is adjusted to vary the force required for exercising the corresponding leg of the user.

In the preferred embodiment, the elastic cords are in the form of bungee cords. One end of each bungee cord is connected to the frame assembly at an elevated end of the guide rails. The bungee cords wrap around a reversing roller situated adjacent the vertex of the frame assembly. The free end of the bungee cords are then directed under the carriage assembly back towards the elevated end of the guide rails. Thus, the knots on the free end extend to engage the notches in the fore carriage plate in captured relation.

The leg exercising apparatus further includes a pad for the user to lie on during the exercise program. The pad is attached to the frame so that the weight of the user acts to maintain the position of the exercising apparatus for hands-free operation. The pad is detachable to further facilitate portability and storage when not in use.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Figure 1:
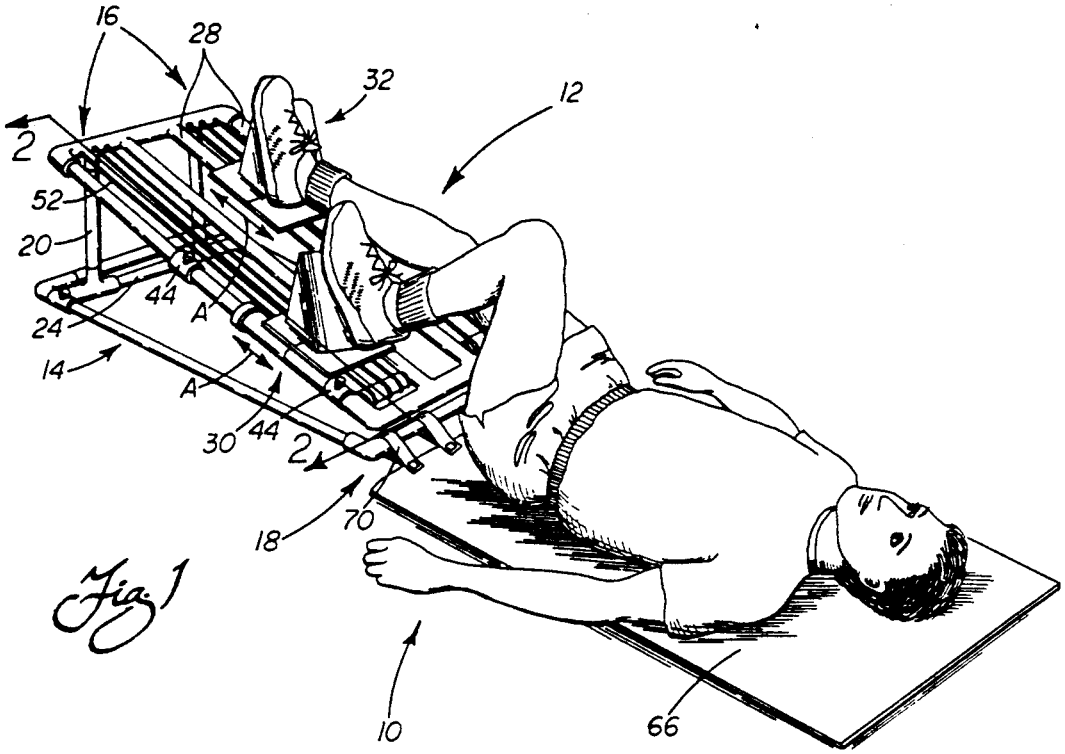
FIG. 1 is a perspective view of the leg exercising apparatus of the present invention in operation by a user.

Reference will now be made in detail to the present preferred embodiment of the invention, an example of which is illustrated in the accompanying drawing.

DETAILED DESCRIPTION OF THE INVENTION

The drawing figures illustrate the embodiment of the portable leg exercising apparatus of the present invention. The apparatus is particularly useful for those who require rehabilitation of the lower back and lower extremities with minimal stress. The resistance applied during operation is adjustable to enable the user to find an acceptable comfort level while still allowing beneficial exercise. Finally, the leg exercising apparatus is collapsible into a compact configuration for portability and storage.

FIG. 1 shows the leg exercising apparatus 10 in operation by a user. The inventive apparatus 10 is particularly adapted to allow the user to perform exercises to rehabilitate the lower back and lower extremities, such as the ankles and knees, while in a reclined position. This substantially reduces the undesirable stress experienced by this body area. As will be seen in detail later, use of the leg exercising apparatus 10 achieves the desired rehabilitative results while maintaining a physically safe resistance level, as well as an acceptable comfort level, for the user.

The preferred embodiment of the apparatus 10 contemplates a frame assembly, generally referred to as numeral 12, that is of lightweight, tubular plastic material for ease in handling. Advantageously, the frame assembly 12 is substantially V-shaped when set up for operation (see FIG. 2). The frame assembly 12 comprises a base and a pair of spaced guide rails, generally designated by reference numerals 14, 16, respectively. The base 14 preferably defines a rectangle, and is disposed in a substantially horizontal plane to form one side of the "V" when the apparatus 10 is in the operable configuration. The guide rails 16 extend upwardly at an incline to form the other side of the "V". The base 14 and the inclined guide rails 16 are connected at a vertex 18 to generally define the meeting point of the "V".

As shown in FIG. 1, the user lies in a reclining position adjacent the vertex 18 of the frame assembly 12 when exercising. A pair of braces 20 support the guide rails 16 above the base 14 at the part of the frame assembly 12 remote from the user. This working configuration defines the upward incline for use, thereby facilitating an advantageous biomechanical result of substantial lower extremity flexing and aerobic exercising without undesirable compression of the spine.

The relative dimensions of the base 14, guide rails 16 and support braces 20 of the preferred embodiment advantageously create an angle of approximately 20 degrees when the apparatus 10 is fully set up to its maximum incline for operation. In a further aspect of the invention, the angle of inclination is adjustable to allow the user to establish the most comfortable operable position for the exercise program. The range of adjustment also facilitates the collapsibility of the apparatus 10 into a flat configuration for portability and storage, as is more fully described below.

Figure 2:
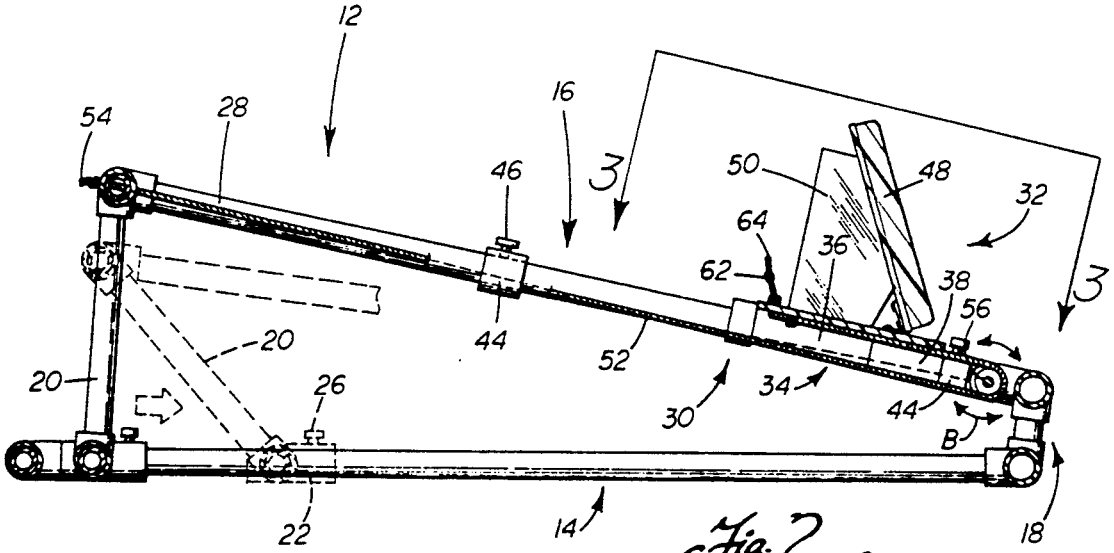
FIG. 2 is a cross-sectional view of the leg exercising apparatus, taken along lines 2—2 of FIG. 1 and further showing the adjustability of the adjustable collar in phantom line to vary the incline of the guide rails.

The variability of the angle of inclination of the guide rails 16 is specifically determined by the positioning of the support braces 20. As best shown in FIG. 2, the bottom of each support brace 20 is pivotally mounted to an adjustable collar 22 that is slidable along a longitudinal tube of the base 1.. Accordingly, as the collar 22 is adjusted along the cooperating tube of the base 14 towards the vertex 18, the corresponding support brace 20 pivots downwardly.

As best shown in FIG. 1, the support braces 20 are preferably connected by a cross tube 24. Thus, both braces 20 pivot together to allow the spaced guide rails 16 to be supported at the same angle of inclination. This allows the user to exercise the lower body extremities equally. Once the desired operating angle of inclination is established, the adjustable collar 22 associated with each brace 20 (only one shown) is secured in place at a substantially equal location from the vertex 18. An adjustment screw 26 cooperates with each collar 22. The screw 26 is alternatively loosened to permit sliding of the collar 22 and tightened to engage the tube of the base 14 when the collar 22 is properly positioned.

In the preferred embodiment of the leg exercising apparatus 10, each of the guide rails 16 is comprised of a pair of spaced guide tubes 28 extending along the incline. Each pair of guide tubes 28 supports a carriage assembly 30 that is engaged by a foot of the user (see FIG. 1). Each carriage assembly 30 is mounted for independent travel along each pair of guide tubes 28. Accordingly, each leg of the user is flexed and extended independently of the other.

Each carriage assembly 30 includes a foot pedal assembly 32. When in the operable position, the foot pedal assembly 32 is disposed in a substantially upright position. More specifically, as shown in FIG. 2, the pedal assembly 32 extends at a slightly obtuse angle relative to the axis of the guide tubes 28 on the side adjacent the user. This provides the pressure surface of the pedal assemblies at the proper natural angle (see FIG. 1) for a user in the reclining position.

Figure 4:
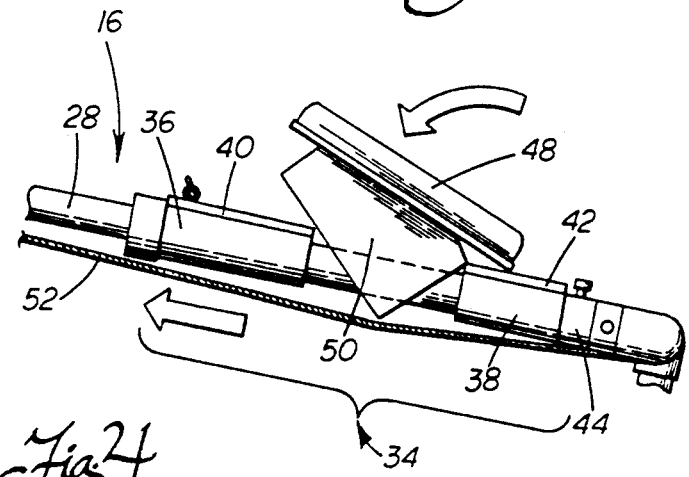
FIG. 4 is a partial side view showing the pivoting movement of a foot pedal assembly as it is being folded into a substantially flat configuration for portability and storage.
Figure 5:
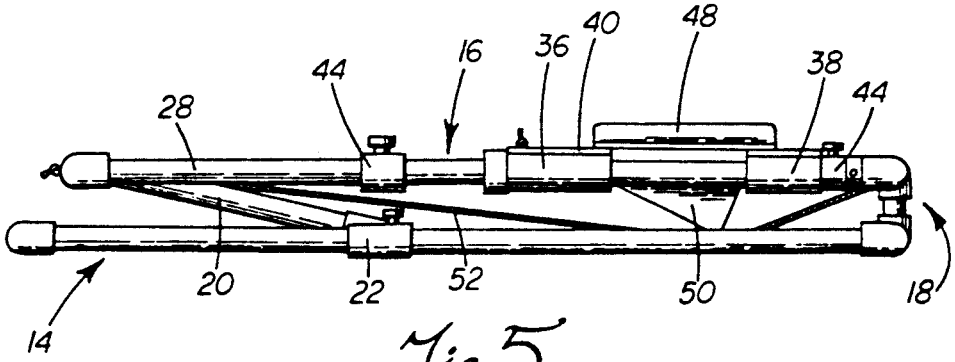
FIG. 5 is a side view showing the leg exercising apparatus in the complete collapsed configuration for portability and storage.

As shown in FIGS. 4 and 5, each foot pedal assembly 32 is collapsible in cooperation with the carriage assembly 30 to further allow the apparatus 10 to obtain a flat configuration for portability and storage, as is further described below.

Each carriage assembly 30 includes a pair of slide collars 34. Each of the slide collars 34 slides along a corresponding one of the pair of guide tubes 28 (see FIGS. 2 and 4). The slide collars 34 respond as a pair to foot pressure applied by the user to the pedal assembly 32, so as to slide along the guide tubes 28, according to action arrows A in FIG. 1.

The versatility of the leg exercising apparatus 10 is enhanced by providing means to vary the leg movement of the user. More specifically, stop collars 44 are provided on at least one of the pair of guide tubes 28 that forms each guide rail 16. The stop collars 44 are slidable to vary the position to which the carriage assembly 30 flexes and extends. A threaded jam screw 46 is provided to secure the collars 44 at the desired position.

In the preferred embodiment, the slide collars 34 are split into a fore carriage section 36, and an aft carriage section 38. The fore carriage section 36 includes a fore plate 40, and the aft carriage section 38 includes an aft plate 42. The fore and aft carriage sections 36, 38, with their corresponding fore and aft carriage plates 40, 42, respectively, are movable relative to each other. This split structural feature is important in the ability of the apparatus 10 to fold into a flat configuration, as will presently be described.

Figure 3:
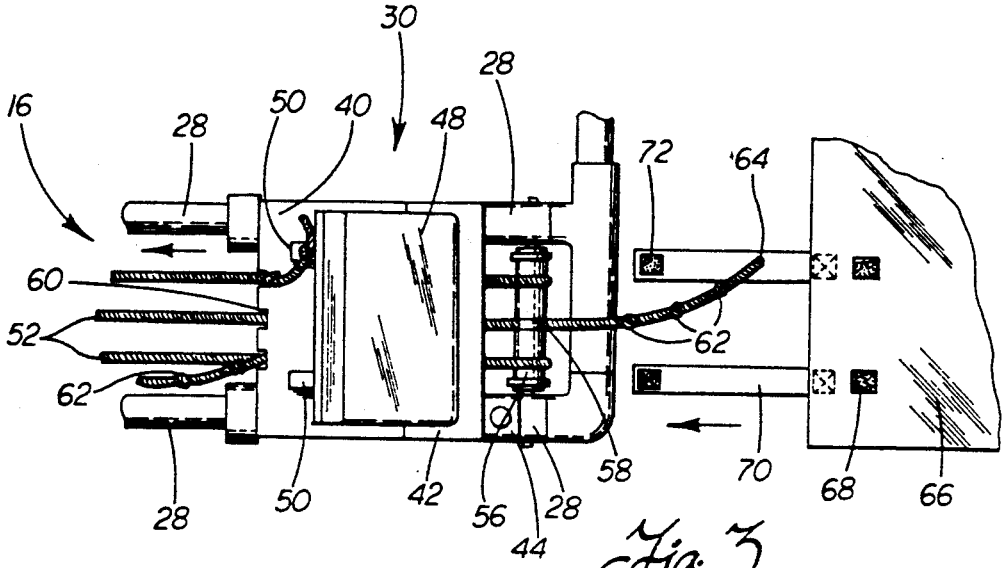
FIG. 3 is a partial view taken along lines 3—3 of FIG. 2, showing a carriage assembly of the leg exercising apparatus with the cooperating elastic cords.

In the preferred embodiment of the invention, each foot pedal assembly 32 includes a foot pedal 48, and one or more angled support blocks 50 attached to the rear thereof (see FIGS. 2 and 3). The support block 50 is hinged to the aft carriage plate 42 and rests on the fore carriage plate 40 to support the foot pedal 48 in the upright position for operation (see FIG. 2).

A plurality of elastic cords are attached to the carriage assembly 30 to provide the exercise resistance. In the preferred embodiment, resilient bungee cords 52 are used. The elastic resistance provided by the cords 52 not only permits a high number of repetitions, but also facilitates repetition at a higher rate of speed. As the distance of exercise is increased by location of the collar 44 further from the vertex 18, the greater the force that must be supplied by the individual legs. The greater force is generally offset by the straightening of the knee of the user, assuring that the leg force needed remains within the narrow range of desired therapeutic exercise and comfort for the user. Accordingly, the inventive apparatus 10 provides ideal exercising movement for lower back musculoskeletal defects and injuries, such as, for example, herniated discs.

In the preferred embodiment, a set of three spaced bungee cords 52 is independently attached to each carriage assembly 30 to allow independent resistance for each leg. The independent attachment allows the cords 52 associated with each carriage assembly 30 to be separately adjustable to vary the resistance as desired. The cords 52 are fixed to the cross piece between the end of the guide rails 16 opposite the vertex 18. As best shown in FIG. 2, the distal end 54 of each cord 52 extends through a hole in the cross piece and is knotted.

Each cord wraps around a reversing roller 56 mounted between the corresponding pair of guide tubes 28 near the vertex 18 (see FIG. 3). The roller 56 oscillates (note action arrows B in FIG. 2) to enable the cords 52 to extend and retract during exercising movement. Each reversible roller 56 has a plurality of grooves 58. Each groove 58 receives a cord 52 therein to assist in maintaining the proper spacing between the cords.

As best shown in FIG. 3, the bungee cords 52 are detachably connected to the fore carriage plate 40. The forward end of the plate 40 is provided with a plurality of notches 60. Each bungee cord 52 is received within an associated notch 60. Each cord 52 is formed with a plurality of knots 62 in spaced relation adjacent its proximal end 64. One of the knots 62 is captured within the associated notch 60, corresponding to the respective cord 52, to thus secure that cord to the fore carriage plate 40.

It can be appreciated that the resistance applied by the bungee cords 52 is adjustable by choosing which of the knots 62 to be received into the notches 60. Accordingly, if it is desired to increase the resistance to induce greater effort by the user, a knot 62 farther from the proximal end 64 of each cord 52 is placed into the corresponding notch 60. One of the cords 52 can be released to provide substantially less resistance (see FIG. 3).

Advantageously, the apparatus 10 is provided with a pad 66 preferably attached at the vertex 18 of the frame assembly 12. The pad 66 provides cushioning for the reclined user during exercising. Furthermore, the weight of the user prevents the frame assembly from shifting as force is applied by the legs to the carriage assemblies 30. Accordingly, the use of the pad 66 provides for hands-free operation of the apparatus 10.

The pad 66 is preferably attached to the frame assembly 12 with the hook-and-loop fastener, commonly known as Velcro. More specifically, patches 68 with loop members may be fixed to the top surface of the pad 66 along one edge. Attachment straps 70 are sewn to the pad and provided with patches 72 of hook members on the free ends. The straps 70 are wrapped around the cross member at the vertex 18, and connected through the hook-and-loop connection mechanism to the top side of the pad 66. Thus, it can be appreciated that the pad 66 is easily detachable to further facilitate use, setup, portability and storage for the apparatus 1? .

As shown in FIGS. 4 and 5, the apparatus 10 is advantageously adapted to collapse into a compact configuration for portability and storage. More specifically, the apparatus 10 is formed to allow the guide rails 16 to fold down adjacent the base 14 so as to create a substantially flat configuration. Furthermore, as mentioned above, the foot pedal assembly 32 is pivotable on its hinge from its upstanding operable position shown in FIG. 2, to a substantially flat position lying adjacent the guide rails 16.

The pivoting operation of the foot pedal assembly 32 is best shown in FIG. 4. The fore carriage section 36 is slid upward with its associated split slide collars 34 on the guide tubes 28. The aft carriage section 38 is held stationary to thus allow separation of the sections. The foot pedal assembly 32 folds downwardly. The angled support block(s) 50 passes downwardly between the spaced guide tubes 28, as illustrated in FIG. 5. Once the foot pedal assembly 32 is lying flat against the guide tubes 28, the fore carriage section 36 is allowed to retreat against the edge of the angled support block(s) 50. This movement occurs naturally due to the elastic biasing action produced by the cords 52 pulling the fore carriage section 36 toward the aft carriage section 38. Thus, the fore carriage section 36 is biased against the foot pedal assembly 32 to keep the latter lying flat for portability and storage. The angle between the block(s) 50 and pedal 48 forms a notch or cut-out that is engaged by the rear edge of the plates 40 to lock the parts of the assembly 10 in the collapsed position (see FIGS. 4 and 5).

In summary, numerous benefits result from the use of the inventive portable leg exercising apparatus 10. Individual carriage assemblies 30 having separate foot pedals 48 are provided to allow the user to independently exercise each leg. Elastic bungee cords 52 provide the ideal resistance opposing the force exerted by the user. This permits a high number of repetitions with comfortable resistance for extended operation. The angle of inclination of the frame assembly 12 is easily adjustable through the pivotal mounting of the support braces 20 and cross tube 24 on the adjustable collars 22. The pivotal mounting of the support braces 20 also facilitates the collapsibility of the frame assembly 12 for ease in portability and storage. The pedal assemblies 32 are pivotable between an upstanding operable position and a flat storage position. Accordingly, the apparatus 10 is ideally suited for rehabilitative exercise for lower extremity and back problems while affording the convenience of easy handling.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A portable leg exercising apparatus for use in a reclined position to provide lower extremity and back rehabilitation of the user, comprising:

a substantially V-shaped frame assembly including guide rail means extending along an elevated, inclined side of said V and a base connected at a vertex forming the other side of said V and positioned adjacent a horizontal surface for use of said assembly for inclined leg exercising;

spaced carriage means for engagement by the feet of the user for independent travel along said guide rail means in response to the pressure applied; and elastic resistance means attached to said carriage means for resisting the force generated by the legs of the user, said elastic resistance means including at least one bungee cord connected at a fixed end to the frame assembly at the elevated end of the guide rail means, a reversing roller adjacent the vertex of said frame assembly over which each bungee cord is received, and means for attaching the free end of said bungee cord to the respective carriage means.

2. The leg exercising apparatus of claim 1, wherein said elastic resistance means includes elastic cords attached between said frame assembly and each carriage means.

3. The leg exercising apparatus of claim 2, wherein said elastic cords are independently attached to each carriage means for providing independent resistance to each carriage means.

4. The leg exercising apparatus of claim 3, wherein said elastic cords are independently adjustable to vary the resistance applied to each carriage means.

5. The leg exercising apparatus of claim 3, wherein each carriage means includes separate foot pedals to apply independent pressure.

6. The leg exercising apparatus of claim 5, further including means for lowering and holding each pedal in a lowered position to facilitate portability and storage of said exercising apparatus when not in use.

7. The leg exercising apparatus of claim 5, said support brace being adjustable over a range to substantially flatten said leg exercising apparatus to facilitate portability and storage, and wherein is provided means to lower said foot pedals to enhance the portability/storage capability.

8. The leg exercising apparatus of claim 1, wherein is provided a support brace extending between said guide rail means and said base for providing the incline.

9. The leg exercising apparatus of claim 8, wherein said base includes spaced tubes extending in a substantially horizontal plane, and an adjustable collar pivotally mounted adjacent the bottom of said support brace and slidable along said base tubes for selective positioning said brace to vary the angle of incline and being adjustable over a range to substantially flatten said leg exercising apparatus to facilitate portability and storage.

10. The leg exercising apparatus of claim 9, wherein said guide rail means includes two pair of guide tubes extending along said incline, a pair of slide collars mounted on each pair of guide tubes, and a foot pedal assembly carried on each pair of slide collars for placement of the feet of the user for applying pressure during exercise.

11. The leg exercising apparatus of claim 10, wherein said slide collars are split into fore and aft carriage sections including fore and aft carriage plates, each foot pedal assembly including a pedal pivotally mounted on respective carriage plate, and an angled support on said pedal and engaging the respective fore carriage plate for positioning the pedal upright for use, said elastic resistance means being connected to each fore carriage section, each pedal and each angled support being pivotally received between fore and aft sections when separated against the elastic force of said resistance means whereby to enhance the portability/storage capability.

12. The leg exercising apparatus of claim 10, wherein is provided two adjustable stop collars on at least one of each pair of guide tubes to independently limit the movement of each leg of the user.

13. The leg exercising apparatus of claim 1, wherein is provided a pad attached to the frame for said user to lie on during use, whereby the weight of said user maintains the position of said leg exercising apparatus for hands free operation.

14. The leg exercising apparatus of claim 1, wherein is provided a plurality of independent bungee cords for each carriage means, a corresponding notch in each carriage means to receive the corresponding cord, and a plurality of enlarged knots along each cord for selective positioning of the cord, whereby adjustment of the elastic resistance for each carriage means may be provided by attaching one or more cords and at a selected knot to vary the force required for exercising each leg of the user.

15. The leg exercising apparatus of claim 1, wherein said frame assembly is constructed from a lightweight, plastic tubular material.

16. The leg exercising apparatus of claim 13, wherein said pad means is detachable.

17. The leg exercising apparatus of claim 13, further including a support brace for said guide rail means attached to said frame assembly to provide the incline.

18. The leg exercising apparatus of claim 17, wherein said support brace is adjustable for varying the angle of inclination of said guide rail means.

19. A portable leg exercising apparatus for use in a reclined position to provide lower extremity and back rehabilitation for the user, comprising:

a substantially V-shaped frame assembly including two pair of guide tubes extending upwardly along an elevated, inclined side of said V;

a base connected at a vertex forming an opposite side of said V and positioned adjacent a horizontal surface for use of said assembly;

a support brace extending between said guide tubes and said base for providing said incline;

said base including spaced tubes extending in a substantially horizontal plane and an adjustable collar pivotally mounted adjacent the bottom of said support brace and slidable along said base tubes for selective positioning of said brace to vary the angle of incline and being adjustable over a range to substantially flatten said leg exercising apparatus to facilitate portability and storage;

a pair of slide collars mounted on each pair of guide tubes;

a foot pedal assembly carried on each pair of slide collars for placement of the feet of the user for applying pressure during exercise, said slide collars being split into fore and aft carriage sections including fore and aft carriage plates, each foot pedal assembly including a pedal pivotally mounted on the respective carriage plate, and an angled support on said pedal and engaging the respective fore carriage plate for positioning the pedal upright for use; and elastic resistance means attached to each foot pedal assembly for resisting the force generated by the legs of the user, said elastic resistance means being connected to each fore carriage section, each pedal and each angled support being pivotally received between said fore and aft sections when separated against the elastic force of said resistance means;

whereby the force applied by the legs of the user moves said foot pedal assemblies along said inclined guide tubes against the elastic resistance so as to provide substantially ideal exercise for the lower back.

* * * * *